US005123303A

United States Patent [19]

Lee et al.

[11] Patent Number: 5,123,303

[45] Date of Patent: Jun. 23, 1992

[54] IMPACT TOOL, HANDLE ASSEMBLY AND METHOD OF ATTACHING HANDLE TO HEAD

[76] Inventors: Lawrence K. Lee, 1727 Country Club Dr., Sugar Land, Tex. 77478; Christopher K. Lee, 7596 Harwin Dr., Houston, Tex. 77036

[21] Appl. No.: 231,957

[22] Filed: Aug. 15, 1988

[51] Int. Cl.[5] ..... B21H 7/06

[52] U.S. Cl. ..... 76/103; 81/20; 254/26 R

[58] Field of Search ..... 7/143, 145-147, 7/159, 170; 76/103; 81/20; 254/26 R

[56] References Cited

U.S. PATENT DOCUMENTS

| | | | |
|---|---|---|---|
| 1,412,610 | 4/1922 | Foley | 81/20 X |
| 2,435,556 | 2/1948 | Curatole | 81/20 |
| 2,611,178 | 9/1952 | Whipple et al. | 7/167 X |
| 2,754,863 | 7/1956 | Yearley | 81/20 X |
| 4,165,771 | 8/1979 | Curati | 81/20 |

FOREIGN PATENT DOCUMENTS

| | | | |
|---|---|---|---|
| 74511 | 2/1948 | Norway | 254/26 R |
| 922680 | 4/1963 | United Kingdom | 81/20 |

*Primary Examiner*—James G. Smith

*Attorney, Agent, or Firm*—Neal J. Mosely

[57] ABSTRACT

An impact tool is disclosed comprising a striking head, such as a hammer (claw, ball peen, ripping or sledge), axe or adze, having a handle-receiving socket extending therethrough with walls tapering toward the handle-receiving opening. The head has aligned holes in two opposite walls adjacent to the handle receiving opening. A handle has a head portion inserted in the socket and a handle portion. The handle head portion has a plurality of gripping surfaces engaging the walls of the socket and a laterally extending hole aligned with the handle head holes. Securing means, such as a two-piece holding screw, bolt, or rivet extends through the aligned handle head and striking head holes and a setting-type plastic resin, such as an epoxy or polyurethane resin, fills the space around the handle head portion in the socket to the end of the socket opposite the handle-receiving opening to secure the striking head against dislodgement during use. The securing means may be a two-piece holding screw with a socket opening for receiving the stem of a socket tool or may secure a carrying clip against the impact head. When the striking head is a claw hammer, one tooth of the claw may have a v-shaped slot for removing tacks. The invention is preferably used for handles of fiberglass.

2 Claims, 2 Drawing Sheets

IMPACT TOOL, HANDLE ASSEMBLY AND METHOD OF ATTACHING HANDLE TO HEAD

BACKGROUND OF THE INVENTION

1. Field of the Invention

This invention relates generally to impact tools and more particularly to hammers, axes, adzes, etc., and improved means for attaching the handles thereto.

2. Brief Description of the Prior Art

Fish U.S. Pat. No. 4,188,703 discloses a hammer having its head held in place on the handle by wedges with plastic filled into the space between the handle and the hammer head.

Curati U.S. Pat. No. 4,165,771 discloses a hammer having a fiber glass handle with ribs which engage a tapered socket in the hammer head and the plastic filling the space between the handle and the socket in the hammer head.

Bigelow U.S. Pat. No. 378,650 discloses a hammer with wedges driven into the end of the handle and plates or straps fastened to the handle which hook into recesses in the hammer head.

Cochran U.S. Pat. No. 786,630 discloses a hammer secured in place by a molten metal poured into openings in the end of the handle to cause it to expand to a snug fit in the hammer socket.

Foley U.S. Pat. No. 1,412,610 discloses a hammer having a threaded bushing extending through the socket which receives the hammer handle and the handle itself.

Carmien U.S. Pat. No. 3,888,721 discloses a tool for securing a fiber glass handle in a hammer head.

Carmien U.S. Pat. No. 3,935,055 discloses a tool and method for anchoring a fiber glass handle in a hammer head.

Stewart U.S. Pat. No. 3,677,187 discloses the use of a bolt and nut connection for securing a handle to a tamping bar.

The present invention is distinguished over the prior art in general, and these patents in particular by an impact tool comprising a striking head, such as a hammer (claw, ball peen, ripping or sledge), axe or adze, having a handle-receiving socket extending therethrough with walls tapering toward the handle-receiving opening. The head has aligned holes in two opposite walls adjacent to the handle receiving opening. A handle has a head portion inserted in the socket and a handle portion. The handle head portion has a plurality of gripping surfaces engaging the walls of the socket and a laterally extending hole aligned with the handle head holes. Securing means, such as a two-piece holding screw, bolt, or rivet extends through the aligned handle head and striking head holes and a setting-type plastic resin, such as an epoxy or polyurethane resin, fills the space around the handle head portion in the socket to the end of the socket opposite the handle-receiving opening to secure the striking head against dislodgement during use. The securing means may be a two-piece holding screw with a socket opening for receiving the stem of a socket tool or may secure a carrying clip against the impact head. When the striking head is a claw hammer, one tooth of the claw may have a v-shaped slot for removing tacks. The invention is preferably used for handles of fiberglass.

SUMMARY OF THE INVENTION

It is therefore an object of the present invention to provide a new and improved impact tool, such as a hammer, axe or adze, having an improved means for securing the handle thereon.

It is another object of this invention is to provide a new and improved impact tool, such as a hammer, axe or adze, having an improved means for securing a fiberglass handle thereon.

Another object of this invention is to provide a new and improved impact tool, such as a hammer, axe or adze, havinq a handle secured thereon by a bolt, rivet, two-piece holding screw, or the like, extending through the handle socket and the end of the handle Another object of this invention is to provide a new and improved impact tool, such as a hammer, axe or adze, having a handle secured thereon by a bolt, rivet, two-piece holding screw, or the like, extending through the handle socket and the end of the handle and further anchored in place by setting-type resin, e.g., epoxy or polyurethane, filling the socket around the end of the handle.

Still another object of this invention is to provide a new and improved impact tool, such as a hammer, axe or adze, having a fiberglass handle secured thereon by a bolt, rivet, two-piece holding screw, or the like, extending through the handle socket and the end of the handle and further anchored in place by setting-type resin, e.g., epoxy or polyurethane, filling the socket around the end of the handle.

Still another object of this invention is to provide a new and improved claw hammer having a fiberglass handle secured thereon by a bolt, rivet, two-piece holding screw, or the like, extending through the handle socket and the end of the handle and further anchored in place by setting-type resin, e.g., epoxy or polyurethane, filling the socket around the end of the handle.

A further object of this invention is to provide a new and improved claw hammer having a fiberglass handle secured thereon by a bolt, rivet, two-piece holding screw, or the like, extending through the handle socket and the end of the handle and further anchored in place by setting-type resin e.g., epoxy or polyurethane, filling the socket around the end of the handle, the hammer claw having the further feature of a tack-pulling v-groove.

A further object of this invention is to provide a new and improved impact tool, such as a hammer, axe or adze, having a fiberglass handle secured thereon by a bolt, rivet, two-piece holding screw, or the like, extending through the handle socket and the end of the handle and further anchored in place by setting-type resin, e.g., epoxy or polyurethane, filling the socket around the end of the handle, and the bolt, rivet or holding screw holding a carrying clip in place.

A further object of this invention is to provide a new and improved impact tool, such as a hammer, axe or adze, having a fiberglass handle secured thereon by a bolt, rivet, two-piece holdinq screw, or the like extending through the handle socket and the end of the handle and further anchored in place by setting-type resin, e.g., epoxy or polyurethane, filling the socket around the end of the handle, and the bolt, rivet or holding screw including a socket to permit use of the tool as a socket driver for socket wrenches and similar tools.

Other objects of the invention will become apparent from time to time throughout the specification and claims as hereinafter related.

The above noted objects and other objects of the invention are accomplished by a novel impact tool comprising a striking head, such as a hammer (claw, ball peen, ripping or sledge), axe or adze, having a handle-receiving socket extending therethrough with walls tapering toward the handle-receiving opening. The head has aligned holes in two opposite walls adjacent to the handle receiving opening. A handle has a head portion inserted in the socket and a handle portion. The handle head portion has a plurality of gripping surfaces engaging the walls of the socket and a laterally extending hole aligned with the handle head holes. Securing means, such as a two-piece holding screw, bolt, or rivet extends through the aligned handle head and striking head holes and a setting-type plastic resin, such as an epoxy or polyurethane resin, fills the space around the handle head portion in the socket to the end of the socket opposite the handle-receiving opening to secure the striking head against dislodgement during use. The securing means may be a two-piece holding screw with a socket opening for receiving the stem of a socket tool or may secure a carrying clip against the impact head. When the striking head is a claw hammer, one tooth of the claw may have a v-shaped slot for removing tacks. The invention is preferably used for handles of fiberglass.

BRIEF DESCRIPTION OF THE DRAWINGS

FIG. 6 is view in elevation of an embodiment of this invention in which the holding screw includes a socket for use of the tool as a socket driver for socket wrenches and the like.

DESCRIPTION OF THE PREFERRED EMBODIMENTS

Figure 1:
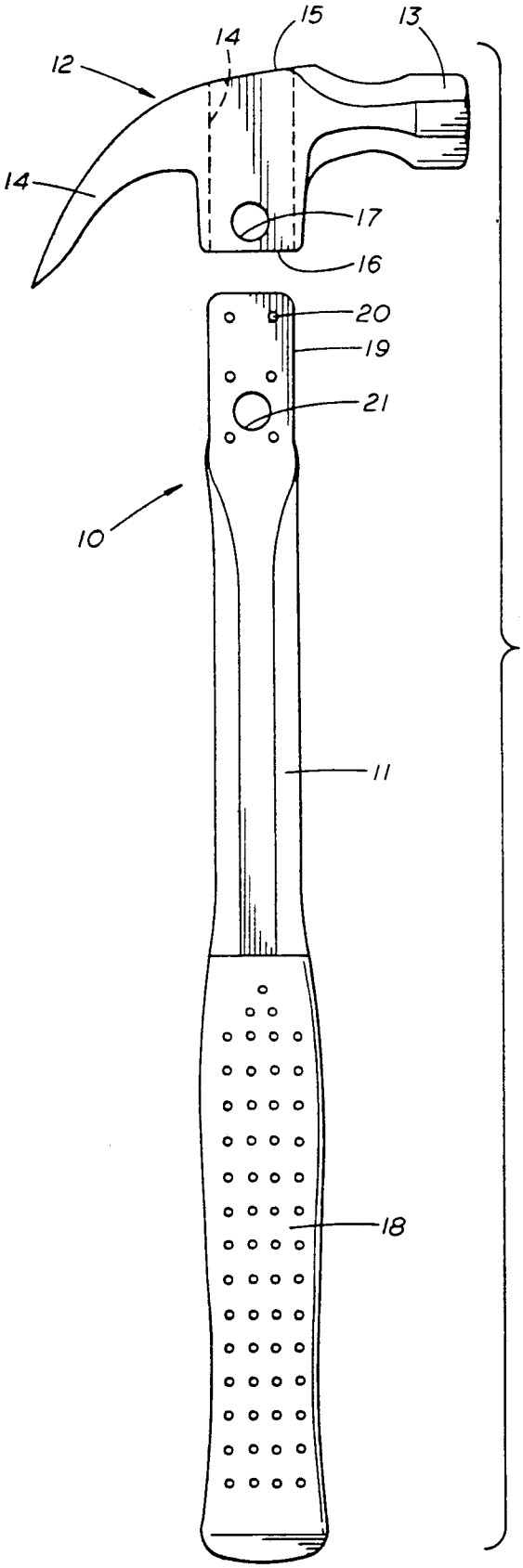
FIG. 1 is an exploded view of hammer and handle illustrating a preferred embodiment of this invention.

Referring to the drawings by numerals of reference, and more particularly to FIGS. 1–4, there is shown a hammer assembly 10 comprising a handle 11 and hammer head 12. The invention is described with particular emphasis upon a hammer construction but would be applicable also to other striking heads such as a ball peen hammer, a rip hammer, an axe, an adze or the like.

Hammer head 12 is shown as a conventional claw hammer having a striking head portion 13 and a claw portion 14. Hammer head 12 has a socket passage 14 which is slightly wider at the top end 15 than at the bottom end 16. The side walls of socket opening 14 have opposed holes or apertures 17 adjacent to the lower end portion 16. Handle 11 is preferably of fiberglass material, although the invention can be used with handles of wood or other materials. Fiber glass handle 11 has a covered grip portion 18 and an upper end portion 19 having a plurality of beads or ribs 20 for engaging the walls of hammer head socket 14. Handle 11, has an opening or aperture 21 which is sized and located to be aligned with apertures 17 and hammer head 12.

When hammer head 12 is assembled on handle 11, the hammer head is driven on the handle until the beads or ribs 20 are tightly fitted against the walls of socket 14 and holes 17 are aligned with hole 21 in handle 11. A suitable securing means is positioned through holes 17 and 21 to assist in securing hammer head 12 in position.

Figure 2:
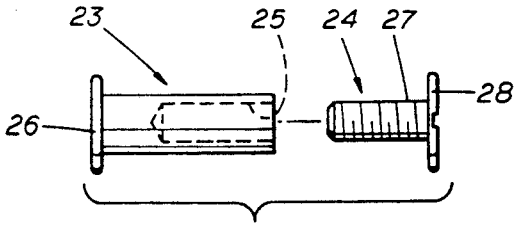
FIG. 2 is an exploded view of a two-piece holding screw used in preferred embodiment of this invention.
Figure 3:
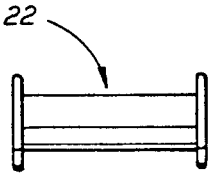
FIG. 3 is a view in elevation of the holding screw shown in FIG. 2.
Figure 4:
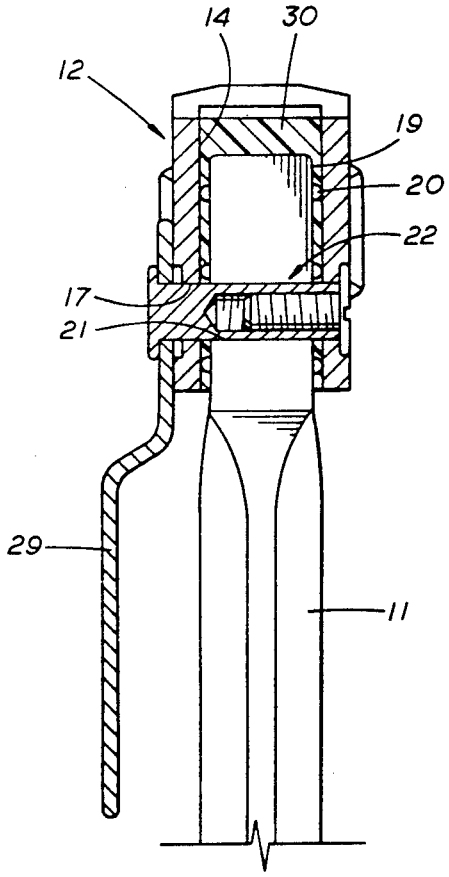
FIG. 4 is cross section of the end of another embodiment of the invention showing a carrying clip held on a hammer head by a two-piece holding screw.

Securing means may be any form of rivet, bolt, or the like. One preferred form of securing means is shown in FIGS. 2–4. This securing means is a holding screw 22 having two parts 23 and 24. Part 23 of holding screw 22 has a threaded female opening 25 and an enlarged head 26. Part 24 of holding screw 22 has male threads 27 and a slotted head 28. Screw portion 24 is screwed inside screw portion 23, as shown in FIG. 4, to secure hammer head 12 in position.

In FIG. 4, the hammer is shown as also having a mounting clip 29 secured in place by the head of part 23 of holding screw 22. Clip 29 serves to secure the hammer on one's belt during periods of none-use. This is an optional feature and may be omitted if desired. After hammer head 12 is secured on handle 11 by holding screw 22, a setting-type resin (thermo-setting or chemically setting) is poured into the space around the end 19 of handle 11 inside hammer socket 14. The setting-type resin 30 fills the space around the end portion 19 of handle 11 and is adhered to the surface of handle 11 and reinforced by bumps or ribs 20. When resin 30 has set, the handle 11 is secured tightly in the hammer socket against dislodging. The securing means, i.e. holding screw 22, and resin 30 cooperate to secure hammer head 12 tightly on handle 11.

OTHER EMBODIMENTS

Figure 5:
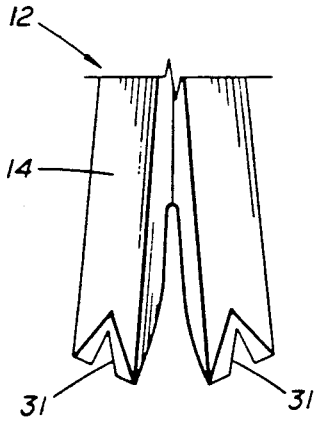
FIG. 5 is a detail view of an embodiment of this invention showing a claw hammer with a v-shaped slot for removing tacks.

In FIG. 5, another embodiment is shown of the invention as shown in FIGS. 1–4. In this embodiment, the method of securing hammer head 12 on handle 11 is the same as shown in FIGS. 1–4. However, the claw portion 14 of hammer head 12 has V-shaped notches 31 at the ends of the claw to assist in removal of tacks by the hammer.

Figure 6:
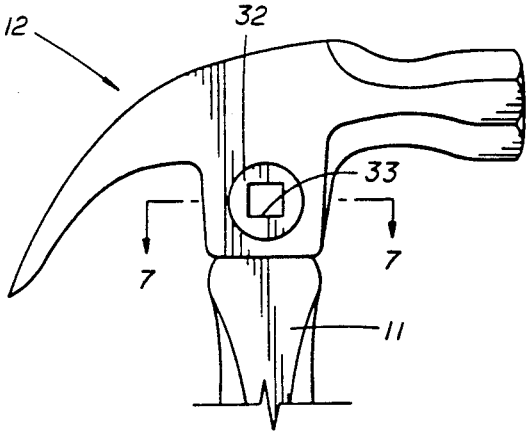
Figure 7:
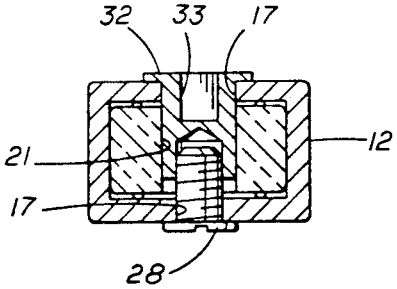
FIG. 7 is sectional view on the line 7—7 of FIG. 6.

FIGS. 6 and 7 show an embodiment of this invention in which a drive socket is incorporated in the securing means for the hammer head and permits the use of the hammer for turning socket tools such as socket wrenches and the like. In this embodiment, holes 17 in hammer head 12 and hole 21 in handle 11 are enlarged, as compared to the structure shown in FIGS. 1–4. In this embodiment, holding screw 22 has an enlarged end portion 32 with a socket opening 33 to be used as a drive for socket tools. The other portion 28 of the securing means is the same as in FIG. 2. In this embodiment, the two-piece holding screw performs the dual function of assisting in securing hammer head 12 on handle 11 and providing a drive socket 33 for use of the handle in operating socket tools.

Figure 8:
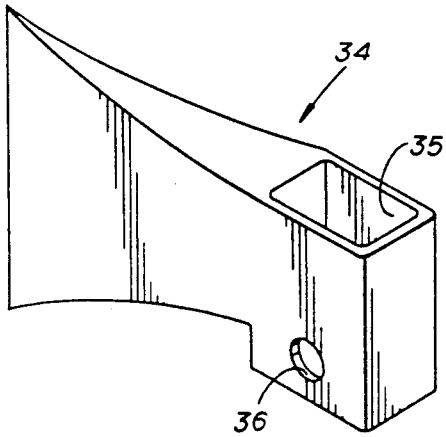
FIG. 8 is a view of the tool head for another embodiment of the invention as applied to an axe head.
Figure 9:
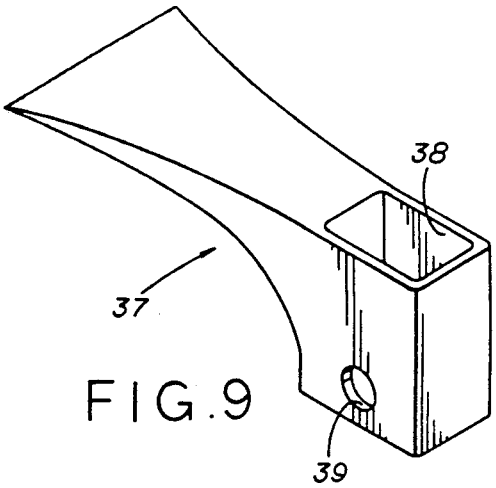
FIG. 9 is a view of the tool head for another embodiment of the invention as applied to an adze.
Figure 10:
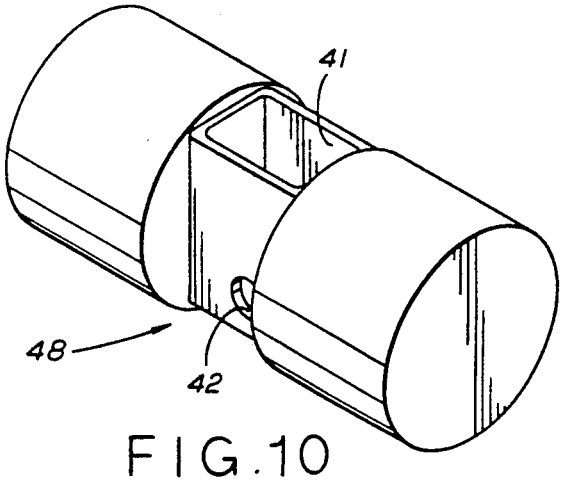
FIG. 10 is a view of the tool head for another embodiment of the invention as applied to a sledge hammer.

FIGS. 8, 9 and 10 illustrate the application of the invention to different impact tools. FIG. 8 shows an axe 34 having a socket opening 35 and holes 36 which receives the holding screw, bolt, or rivet to secure the axe head on handle 11. The axe head is secured in place by the holding screw, bolt, or rivet and the setting-type resin as in FIGS. 1–4. FIG. 9 shows an adze 37 having a socket opening 38 and holes 39 which receives the holding screw, bolt, or rivet to secure the adze head on handle 11. The adze head 37 is secured in place by the holding screw, bolt, or rivet and the setting-type resin as in FIGS. 1–4. FIG. 10 shows a sledge 40 having a socket opening 41 and holes 42 which receives the holding screw, bolt, or rivet to secure the axe head on handle 11. The sledge head 40 is secured in place by the holding screw, bolt, or rivet and the setting-type resin as in FIGS. 1–4.

While this invention has been shown fully and completely with special emphasis on certain preferred embodiments, it should be understood that within the scope of the appended claims the invention may be practiced otherwise than as specifically described herein.

We claim:

1. An impact tool comprising a striking head having a handle-receiving socket having a handle receiving opening, said socket extending therethrough with walls tapering uniformly from the top of the head toward the handle-receiving opening, said head having aligned holes in two opposite walls adjacent to the handle receiving opening, a handle formed of resin impregnated fiberglass having a head portion inserted in said socket and a handle portion, said handle head portion having a plurality of gripping surfaces engaging the walls of said socket and having a laterally extending hole aligned with said handle head holes, securing means comprising a two-piece holding screw extending through said aligned handle head and striking head holes, a setting-type epoxy or polyurethane resin filling the space around said handle head portion and said gripping surfaces thereof in said socket to the end of said socket opposite said handle-receiving opening, said securing means and said setting-type resin cooperating to secure said striking head against dislodgement during use, and a carrying clip secured against said impact head by the head of said holding screw.

2. A method of producing an impact tool comprising providing a striking head having a handle-receiving socket having a handle receiving opening, said socket extending therethrough with walls tapering uniformly from the top of the head toward the handle-receiving opening, said head having aligned holes in two opposite walls adjacent to the handle receiving opening, providing a handle having a head portion and a handle portion, said handle head portion having a plurality of gripping surfaces and a laterally extending hole for alignment with said handle head holes, inserting said handle head portion into said socket until said gripping surfaces engage the walls of said socket and said striking head holes are aligned with said handle head portion holes, positioning securing means comprising a two-piece holding screw through said aligned handle head and striking head holes, positioning a carrying clip against said impact head and securing said clip by the head of said holding screw, and filling the space around said handle head portion in said socket to the end of said socket opposite said handle-receiving opening with a setting-type epoxy or polyurethane resin, said securing means and said setting-type resin cooperating to secure said striking head against dislodgement during use.

* * * * *